US006767849B2

(12) United States Patent
Rock et al.

(10) Patent No.: US 6,767,849 B2
(45) Date of Patent: Jul. 27, 2004

(54) FABRIC WITH DISPARATE SURFACE PROPERTIES

(75) Inventors: Moshe Rock, Brookline, MA (US); Amiram Inbal, Brookline, MA (US); Charles Haryslak, Haverhill, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 103 days.

(21) Appl. No.: 09/963,127

(22) Filed: Sep. 24, 2001

(65) Prior Publication Data

US 2003/0060111 A1 Mar. 27, 2003

(51) Int. Cl.[7] ..... B32B 27/04; B32B 27/12; B32B 31/30; B32B 5/02

(52) U.S. Cl. ..... 442/67; 442/62; 442/65; 442/79; 442/82; 442/118; 442/304; 442/315; 427/209; 66/169

(58) Field of Search ..... 442/62, 65, 67, 442/79, 82, 118, 304, 315; 427/209; 66/169

(56) References Cited

U.S. PATENT DOCUMENTS

| | | | | |
|---|---|---|---|---|
| 3,852,000 | A | | 12/1974 | Leonard et al. |
| 3,868,728 | A | | 3/1975 | Krzewinski |
| 4,194,041 | A | | 3/1980 | Gore et al. |
| 4,454,191 | A | | 6/1984 | von Blücher et al. |
| 4,560,611 | A | | 12/1985 | Naka et al. |
| 4,666,764 | A | * | 5/1987 | Kobayashi et al. ..... 442/60 |
| 4,732,015 | A | * | 3/1988 | Abrams et al. ..... 66/172 E |
| 4,774,131 | A | | 9/1988 | Dahmen et al. |
| 4,863,788 | A | | 9/1989 | Bellairs et al. |
| 5,019,422 | A | | 5/1991 | Rose et al. |
| 5,056,600 | A | * | 10/1991 | Surjaatmadja et al. ..... 166/373 |
| 5,204,156 | A | | 4/1993 | Lumb et al. |
| 5,364,678 | A | | 11/1994 | Lumb et al. |
| 5,736,466 | A | | 4/1998 | Wierer et al. |
| 5,753,568 | A | | 5/1998 | Shimano et al. |
| 5,874,164 | A | | 2/1999 | Caldwell |
| 6,040,251 | A | | 3/2000 | Caldwell |
| 6,129,978 | A | | 10/2000 | Caldwell |
| 6,359,079 | B1 | * | 3/2002 | Palmer, Jr. ..... 525/440 |

FOREIGN PATENT DOCUMENTS

| | | | | |
|---|---|---|---|---|
| JP | 60-224871 | A | * 11/1985 | ..... D06M/15/13 |

* cited by examiner

*Primary Examiner*—Elizabeth M. Cole
*Assistant Examiner*—Norca L. Torres
(74) *Attorney, Agent, or Firm*—Fish & Richardson P.C.

(57) ABSTRACT

A raised surface fabric knit on a conventional terry knitting machine is provided. On one face of the fabric, a foamed liquid wicking composition is applied, and on the other face, a foamed liquid repellent composition is applied. Preferably, one or both faces of the fabric are napped prior to application of the foam. Further, it is preferable to first apply the foamed liquid repellent composition before applying the formed liquid wicking composition.

18 Claims, No Drawings

FABRIC WITH DISPARATE SURFACE PROPERTIES

BACKGROUND OF THE INVENTION

This invention relates to a raised surface fabric which is knit on a standard terry knitting machine, and more particularly, to a terry knit raised surface fabric in which one surface is chemically treated to wick liquids, while the other surface is chemically treated to repel liquids.

In general, knitted terry fabrics are a variation of a jersey knit fabric wherein two yarns are fed simultaneously into the same needle. Knitted terry is produced for various types of wearing apparel.

In the prior art, it is well known to treat a fabric so that it is suitable for wicking liquids. This is achieved in the prior art by a chemical treatment of the fabric (e.g., with a low molecular weight polyester during dyeing) to increase the fiber/fabric surface tension. It is also well known to chemically treat a fabric so that it repels liquids. This is achieved by a chemical treatment (e.g., with fluorocarbons) to reduce the fiber/fabric surface tension.

It is also well known to adhere these two types of chemically treated fabrics so that a composite fabric construction is produced in which one surface wicks liquids and the other surface repels liquids. However, such a composite fabric construction is less than desirable because it is heavy in weight and somewhat stiff.

Accordingly, it would be desirable to provide a raised surface fabric which is knit on a standard terry knitting machine and treated such that one face of the fabric will wick liquids while the other face of the fabric repels liquids.

SUMMARY OF THE INVENTION

Generally speaking, in accordance with the invention, a raised surface fabric knit on a conventional terry knitting machine is provided. On one face of the fabric, a foamed liquid wicking composition is applied, and on the other face, a foamed liquid repellent composition is applied. Preferably, both faces of the fabric are napped prior to application of the foam compositions. Further, it is preferable to first apply the foamed liquid repelling composition before applying the formed liquid wicking composition.

The liquid wicking composition may include a low molecular weight polyester and a foaming agent, while the liquid repellent composition includes a fluorocarbon and a non-wetting foaming agent.

Both the foamed liquid wicking composition and the foamed liquid repellent composition have an air: liquid blow ratio from between about 2:1 and 50:1 by weight. Both compositions are applied in a weight percentage of between 5% and 75% on the weight of the terry fabric.

Accordingly, it is an object of the invention to provide a raised surface fabric knit on a standard terry knitting machine.

Another object of the invention is to provide a raised surface fabric knit on a standard terry machine in which one face of the fabric is chemically treated to wick liquids, while the other face is chemically treated to repel liquids.

A further objective of the invention is to provide a raised surface fabric knit on a standard terry knitting machine in which foam compositions are applied to both faces of the fabric.

Other objects and advantages of the invention will in part be obvious and will in part be apparent from the following description.

The invention accordingly comprises the features of construction, combination of elements and arrangement of parts as hereinafter described, and the scope of the invention will be indicated in the claims.

DETAILED DESCRIPTION OF THE PREFERRED EMBODIMENT

A single face raised surface fabric made in accordance with the invention may comprise a circular knit standard plaited construction. The fabric may comprise a circular knit reverse plaited construction which is suitable for subsequently generating a double face raised surface fabric. The fabric may comprise a circular knit double loop construction which can be raised on one or both faces. While it is preferred to raise both faces of the fabric, it is required that the technical back of the fabric be raised. The raised face is produced through napping, brushing, sanding or other types of "raising" processes.

In accordance with the invention, one face of the fabric (the face to be closest to the skin) is treated or applied with a foamed liquid wicking composition. The foamed liquid wicking composition is preferably a low molecular weight polyester such as Milease T, available from Hodgson Chemical of Mt. Holly, N.C., and Supralev 4470 available from ABCO Industries of Roebuck, S.C. The composition also includes a wettable foaming agent such as Foamer 916, available from Dexter Chemical of Bronx, N.Y. The low molecular weight polyester is present in the liquid-wicking composition in an amount between about 2% and 50% by weight. The foaming agent is present in the composition in an amount between about 0.5% and 10% by weight.

The foamed liquid wicking composition has an air: liquid blow ratio ranging from between about 2:1 to 50:1. The foamed liquid wicking composition is applied to the fabric surface in a weight percentage of between 5% and 75% compared to the weight of the fabric. An example of a suitable foamed liquid wicking composition is the following:

| | |
|---|---|
| Supralev 4470 | 16.25% by weight |
| Foamer Dexter 916 | 2.00% by weight |
| Water | Balance |
| wet pickup 10% on weight of the fabric | |
| blow ratio 40:1 (air:liquid) | |

A foamed liquid repellent composition is applied to the other face of the terry knit fabric and includes a fluorocarbon such as Repearl F-35, Repearl F-23, Repearl 7000 and Repeal F-3700, all available from Mitsubishi International Corporation of High Point, N.C. The fluorocarbon is combined with a non-wetting foaming agent such as Foamer NR50, available from Dexter Chemical of Bronx, N.Y. In addition, additives such as resins, catalysts, foam stabilizers and thickening agents may be added to the composition. The fluorocarbon is present in the liquid repellent composition in an amount between about 2% and 50% by weight. The non-wetting foaming agent is present in the composition in a percentage between about 0.5% and 10% by weight.

The foamed water repellent composition to be applied to the terry fabric should have an air: liquid blow ratio ranging from between about 2:1 to 50:1. The composition is applied to the surface of the fabric in a weight percentage of between 5% and 75% on the weight of the fabric. An example of a suitable foamed liquid repellent composition is the following:

| | |
|---|---|
| Repearl F-23 | 12% by weight |
| Foamer NR50 | 2% by weight |
| Water | Balance |
| wet pickup 13.7% on weight of the fabric. | |
| blow ratio 20:1 (air:liquid) | |

Significantly, in order to avoid excessive penetration of the foamed liquid wicking composition through the fabric, the foamed water repellent composition is first applied to the fabric, then the fabric is dried before the foamed wicking composition is applied and then the fabric is dried a second time. Alternatively, the two foamed compositions can be applied simultaneously, one composition to each face of the fabric following which the fabric is dried.

As alluded to above, one or both fabric faces are preferably raised prior to application of the foamed compositions. This further prevents unwanted penetration of the foamed chemicals. The foamed compositions may be applied to the terry fabric by an FFT—Foam applicator made by Gaston County, as is well known in the art.

Foam is preferred for the purpose of depth of penetration control, e.g., the water repellent should not penetrate further than the stitch yarn. Other means of application include (especially if the fabric is raised), graveure printing, rotary (screen) printing, kiss roll or transfer kiss roll application.

It will thus be seen that the objects set forth above, among those made apparent from the preceding description, are efficiently attained, and certain changes may be made in the invention without departing from its spirit and scope.

What is claimed is:

1. A method of producing a fabric with disparate surface properties comprising the steps of knitting a fabric on a terry knitting machine, the fabric having a first face and an opposite, second face;

applying a liquid-wicking composition on said first face, said liquid-wicking composition comprising a polyester in an amount between about 2% and 50% weight percent and a wettable foaming agent in an amount between about 0.5% and 10% weight percent; and applying a liquid-repelling composition on said opposite, second face; and during the applying steps, limiting the depth of penetration of the compositions into the fabric so that the surface properties of the first surface of the fabric will be different from the properties of the second face.

2. The method of claim 1, further including the step of raising at least one face of said first face and said opposite, second face of said fabric prior to the application of the liquid-wicking composition and the liquid-repelling composition to the at least one face.

3. The method of claim 1, wherein said liquid-repelling composition is a fluorocarbon in an amount between about 2% and 50% weight percent and a non-wetting foaming agent in an amount between about 0.5% and 10% weight percent.

4. The method of claim 1, wherein each of said liquid-wicking composition and said liquid-repelling composition has an air-to-liquid blow ratio between about 2-to-1 and 50-to-1.

5. The method of claim 1, wherein each of said liquid-wicking composition and said liquid-repelling composition is applied to the fabric in an amount between about 5% and 75% by weight.

6. The method of claim 1, wherein the step of applying a liquid-repelling composition is carried out prior to the step of applying the liquid-wicking composition.

7. The method of claim 1 further comprising foaming the liquid-repelling composition and the liquid-wicking composition prior to application, to enhance penetration control.

8. A fabric construction comprising fabric knit on a terry knitting machine, a coating of a liquid-wicking composition on fibers of a first face of the fabric, said liquid-wicking composition comprising a polyester in an amount between about 2% and 50% weight percent and a wettable foaming agent in an amount between about 0.5% and 10% weight percent, and a coating of a liquid-repelling composition on fibers of an opposite, second face of the fabric.

9. The fabric construction of claim 8, wherein at least one face of said first face and said opposite, second face is raised.

10. The fabric construction of claim 8 wherein the coating of liquid-repelling composition does not extend through the fabric to the first face, so that the first and second faces of the fabric have disparate surface properties.

11. The fabric construction of claim 8, wherein said liquid-repelling composition is a fluorocarbon in an amount between about 2% and 50% weight percent and a non-wetting foaming agent in an amount between about 0.5% and 10% weight percent.

12. The fabric construction of claim 8, wherein each of said liquid-wicking composition and said liquid-repelling composition has an air-to-liquid blow ratio between about 2-to-1 and 50-to-1.

13. The fabric construction of claim 8, wherein each of said liquid-wicking composition and said liquid-repelling composition is applied to the fabric in an amount between about 5% and 75% by weight.

14. A fabric construction comprising:

a terry knit fabric having a first raised face and an opposite, second raised face;

a liquid-wicking composition applied to the first raised face of the fabric and comprising a polyester in an amount between about 2% and 50% weight percent and a wettable foaming agent in an amount between about 0.5% and 10% weight percent;

a liquid-repelling composition applied to the opposite, second raised face of the fabric and including a fluorocarbon in amount between about 2% and 50% weight percent and a non-wetting foaming agent in an amount between about 0.5% and 10% weight percent.

15. The fabric construction of claim 14, wherein each of said liquid-wicking composition and said liquid-repelling composition has an air-to-liquid blow ratio between about 2-to-1 and 50-to-1.

16. The fabric construction of claim 15, wherein each of said liquid-wicking composition and liquid-repelling composition is applied to the fabric in an amount between about 5% and 75% by weight.

17. The fabric construction of claim 14, wherein said liquid-repelling composition further includes an additive selected from the group consisting of resins, catalysts, foam stabilizers and thickening agents.

18. The fabric construction of claim 14, wherein the liquid-repelling composition is applied to the opposite, second face of the fabric prior to application of the liquid-wicking composition to the first face of the fabric.

* * * * *